US011674374B2

(12) United States Patent
Jing et al.

(10) Patent No.: US 11,674,374 B2
(45) Date of Patent: Jun. 13, 2023

(54) LUBRICATING ELEMENT FOR DRAG REDUCTION IN PRODUCTION AND TRANSPORTATION OF WATER-CUT HEAVY OIL IN WELLBORE

(71) Applicant: SOUTHWEST PETROLEUM UNIVERSITY, Chengdu (CN)

(72) Inventors: Jiaqiang Jing, Chengdu (CN); Wanni Huang, Chengdu (CN); Jie Sun, Chengdu (CN); Bo Ren, Chengdu (CN); Junhua Ye, Chengdu (CN); Peiyu Jing, Chengdu (CN); Jiatong Tan, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 75 days.

(21) Appl. No.: 17/376,220

(22) Filed: Jul. 15, 2021

(65) Prior Publication Data

US 2022/0090480 A1 Mar. 24, 2022

(30) Foreign Application Priority Data

Sep. 22, 2020 (CN) ..... 202010999957.7

(51) Int. Cl.

| | |
|---|---|
| ***E21B 43/38*** | (2006.01) |
| ***E21B 43/12*** | (2006.01) |
| ***E21B 43/20*** | (2006.01) |
| ***E21B 34/06*** | (2006.01) |

(52) U.S. Cl.

CPC ..... *E21B 43/385* (2013.01); *E21B 34/06* (2013.01); *E21B 43/127* (2013.01); *E21B 43/20* (2013.01)

(58) Field of Classification Search

CPC ..... E21B 43/385; E21B 43/38; E21B 43/35; E21B 43/40; E21B 43/20; E21B 43/16; E21B 43/127; E21B 34/06; B01D 17/0217; B04C 5/12; B04C 5/103; B04C 5/081; B04C 5/14

See application file for complete search history.

(56) References Cited

U.S. PATENT DOCUMENTS 6,260,619 B1 * 7/2001 Svedeman ..... E21B 43/385 166/265
6,494,258 B1 * 12/2002 Weingarten ..... E21B 43/38 166/265

FOREIGN PATENT DOCUMENTS

CN 110924921 B * 9/2020

* cited by examiner

*Primary Examiner* — George S Gray
(74) *Attorney, Agent, or Firm* — Hauptman Ham, LLP

(57) ABSTRACT

A lubricating element for drag reduction in production and transportation of water-cut heavy oil in a wellbore comprises a flow guide component and a shell component; the flow guide component is fixed in a cyclone chamber of the shell component, and is provided with an intermediate rod to connect and fix a center cone, a flow stabilizing cone and flow guide blades. The lubricating element is a static element integrating three functions of oil-water separation, water control and liquid ring formation, thereby reducing energy consumption for production and transportation of heavy crude oil, and cutting down surface water treatment facilities.

5 Claims, 2 Drawing Sheets

LUBRICATING ELEMENT FOR DRAG REDUCTION IN PRODUCTION AND TRANSPORTATION OF WATER-CUT HEAVY OIL IN WELLBORE

CROSS REFERENCE TO RELATED APPLICATIONS

This application claims priority to Chinese Patent Application No. 202010999957.7 filed Sep. 22, 2020, the disclosure of which is herein incorporated by reference in its entirety.

FIELD OF THE INVENTION

The present invention relates to a lubricating element for drag reduction in production and transportation of water-cut heavy oil in a wellbore, and belongs to the technical field of drag reduction in production and transportation of heavy crude oil.

BACKGROUND

As a special crude oil, heavy oil contains a large amount of resin and asphaltene, and has the characteristics of high density, high viscosity and poor fluidity, which leads to large pipeline pressure loss, complicated process flow, complex supporting processing facilities and high maintenance and operation costs during production, gathering and transportation. In an oil reservoir, the fluidity of water-cut heavy oil is relatively good, but after the heavy oil flows into a wellbore, the temperature decreases gradually as the heavy oil is lifted, which leads to increase in heavy oil flow drag and difficulty in lifting, resulting in difficulties in production and transportation. After the water-cut heavy oil is lifted to the ground, the construction and management costs of surface water treatment facilities will increase, resulting in economic losses.

Existing methods for drag reduction in production and transportation of heavy oil at home and abroad include adding viscosity reducers, mixing with thin oil, mixing with sewage, electric heating and low viscosity liquid ring transportation. However, conventional methods for drag reduction of heavy oil have some shortcomings: the cost of adding a viscosity reducer is high, and an oilfield needs to formulate the viscosity reducer based on its own actual situation; mixing with thin oil requires thin oil resources, and produced fluid will be emulsified in a reversed phase when water content of an oil well reaches a certain amount, resulting in failure to achieve ideal viscosity reduction effect; mixing with sewage causes the produced fluid to fail to form a uniform oil-in-water emulsion, resulting in failure to achieve ideal viscosity reduction effect, and since the sewage contains impurities, excessive mixing will pollute the oil layer and affect well yield, resulting in losses to the oil filed; electric heating is costly to operate and susceptible to various factors, the heating depth in a wellbore is limited, and formation water with high salinity will shorten the service life of electric heating tools.

From the perspective of macroscopic effect, among the methods to improve the fluidity of water-cut heavy oil in wellbores, the flow drag reduction effect on heavy crude oil transported by a low viscosity liquid ring is obvious, and cyclone separation is also effective in reducing the water content of produced fluid. Therefore, a lubricating element is designed by integrating oil-water cyclone separation, discharge water flow control and low viscosity liquid ring transportation. By controlling the discharge water flow, part of water separated from water-cut heavy oil in a wellbore is reinjected into the formation, the remaining water forms a low viscosity liquid ring with an appropriate thickness, the low viscosity liquid ring encloses the heavy oil to form an annular flow for drag reduction for transportation, which can not only reduce the drag during production and transportation of heavy oil, but also avoid the disadvantages of the above-mentioned conventional methods for production and transportation of heavy oil.

SUMMARY

The present invention provides a lubricating element for drag reduction in production and transportation of water-cut heavy oil in a wellbore by combining two processes of oil-water cyclone separation and low viscosity liquid ring formation.

The present invention provides a lubricating element for drag reduction in production and transportation of water-cut heavy oil in a wellbore, comprising a flow guide component composed of an intermediate rod, flow guide blades, a center cone and a flow stabilizing cone, and a shell component composed of an inlet pipe, a cyclone pipe, a water outlet pipe, a drain cavity, a drain pipe and a ring formation pipe. Specifically, the inlet pipe is funnel-shaped, with the larger end connected with the cyclone pipe, and the smaller end connected with an upstream production and transportation pipe; a tapered section in the middle part of the cyclone pipe can not only prevent the flow guide component from sliding into the drain pipe during assembly, but also improve the oil-water separation efficiency; the flow guide component is composed of a flow stabilizing cone, an intermediate rod, flow guide blades and a center cone, where the flow stabilizing cone allows incoming liquid to uniformly and stably flow into four chambers divided by the flow guide blades, the intermediate rod is used for fixedly connecting four flow guide blades, the flow guide blades are distributed in a flow channel at an interval of 90° and integrated by using arc sections and straight sections, the incoming liquid is diverted at the arc sections of the blades, the flow direction of fluid is stabilized at the straight sections of the blades, oil is separated from water by centrifugal force, the oil phase gathers along the central axis, the water phase flows upward along the wall of the cyclone pipe, the center cone is located at the outlet axis of the blades, with the top cone tip at the same level as the bottom of the water outlet pipe, and the bottom fixedly connected with the intermediate rod to facilitate elimination of an air column and allow the separated oil phase to gather to form a stable columnar oil core, and the oil core is enclosed by an annular water flow; the water outlet pipe is frustum-shaped, with four strip outlet holes evenly distributed around to discharge most of water in produced fluid; the drain cavity is cylindrical and located outside the water outlet pipe, and encloses the water outlet pipe, with the lower edge of the drain cavity connected with the drain pipe, and a water control valve is connected to the drain pipe to adjust flow at the water drain opening, thereby controlling the thickness of a low viscosity liquid ring at the flow outlet; after the drain cavity collects and stabilizes liquid from the water outlet pipe, the collected water phase is discharged from the water drain opening through the drain pipe; a water ring output by the water outlet pipe encloses a central oil core to form a heavy oil-water flow for lubrication and drag reduction for transportation. The lubricating element is provided with a feed inlet, a water drain opening and a heavy oil-water flow outlet with water as an outer ring and heavy oil as a center.

The present invention has the following advantageous effects:

1. Tapered pipes at both ends of a flow guide blade help to fix the flow guide blade and prevent the flow guide blade from jittering and slipping when the lubricating element is running to keep working conditions stable.

2. When the lubricating element is applied to drag reduction in production and transportation of water-cut heavy oil, a heavy oil-water flow with water as an outer ring and heavy oil as a center can be formed, and good flow stability can be maintained in a pipeline. Since heavy oil is not in direct contact with the inner wall of the pipeline, flow drag of heavy oil during production and transportation can be effectively reduced and the recovery ratio of heavy oil can be improved.

3. Most of water separated by the lubricating element is discharged and reinjected into the formation, thereby cutting down surface water treatment facilities and reducing surface gathering and transportation costs.

4. The lubricating element also has the functions of downhole oil-water separation and low viscosity liquid ring lubrication, and the machining cost is low, so the lubricating element is worth to be applied in production and transportation of water-cut crude oil.

BRIEF DESCRIPTION OF THE DRAWINGS

In FIG. 1, 1-water outlet pipe, 2-drain cavity, 3-cyclone pipe, 4-intermediate rod, 5-inlet pipe, 6-feed inlet, 7-flow outlet, 8-ring formation pipe, 9-strip outlet holes, 10-drain pipe, 11-water drain opening, 12-center cone, 13-flow guide blades, 14-flow stabilizing cone, 15-water control valve.

DETAILED DESCRIPTION OF THE ILLUSTRATIVE INVENTION

Figure 1:
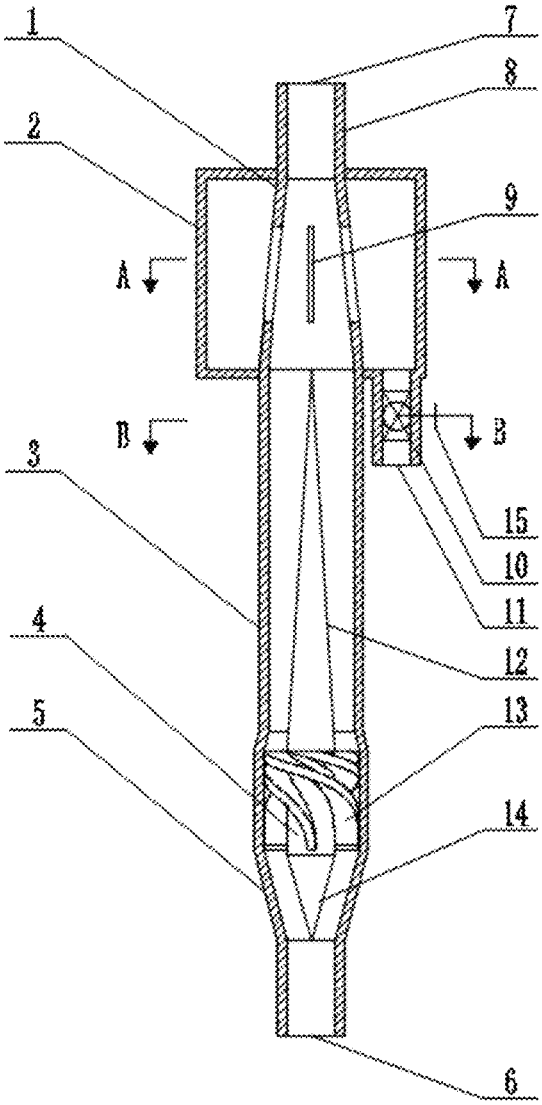
FIG. 1 is a structural diagram of the present invention.
Figure 2:
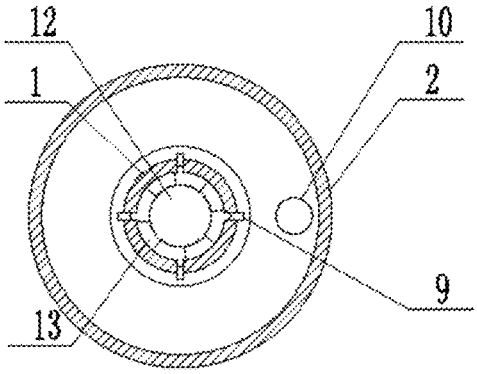
FIG. 2 is a schematic diagram of section A-A in FIG. 1.
Figure 3:
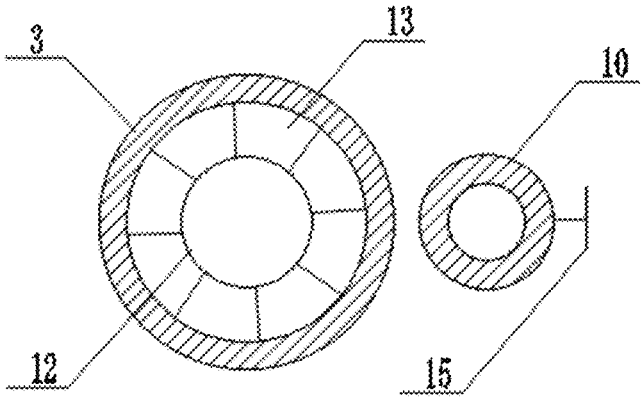
FIG. 3 is a schematic diagram of section B-B in FIG. 1.
Figure 4:
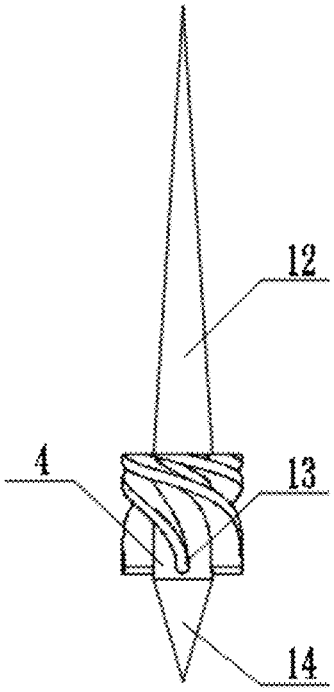
FIG. 4 is a schematic diagram of the flow guide component in FIG. 1.

The present invention will be further described with reference to accompanying drawings and preferred embodiments.

The present invention provides a lubricating element for drag reduction in production and transportation of water-cut heavy oil in a wellbore, comprising a flow guide component composed of an intermediate rod 4, flow guide blades 13, a center cone 12 and a flow stabilizing cone 14, and a shell component composed of an inlet pipe 5, a cyclone pipe 3, a water outlet pipe 1, a drain cavity 2, a drain pipe 10 and a ring formation pipe 8. Specifically, the inlet pipe 5 is funnel-shaped, with the larger end connected with the cyclone pipe 3, and the smaller end connected with an upstream production and transportation pipe; a tapered section in the middle part of the cyclone pipe 3 can not only prevent the flow guide component from sliding into the drain pipe 1 during assembly, but also improve the oil-water separation efficiency; the flow guide component is composed of a flow stabilizing cone 14, an intermediate rod 4, flow guide blades 13 and a center cone 12, where the flow stabilizing cone 14 allows incoming liquid to uniformly and stably flow into four chambers divided by the flow guide blades 13, the intermediate rod 4 is used for fixedly connecting four flow guide blades 13, the flow guide blades 13 are distributed in a flow channel at an interval of 90° and integrated by using arc sections and straight sections, the incoming liquid is diverted at the arc sections of the blades, the flow direction of fluid is stabilized at the straight sections of the blades, oil is separated from water by centrifugal force, the oil phase gathers along the central axis, the water phase flows upward along the wall of the cyclone pipe, the center cone 12 is located at the outlet axis of the blades 13, with the top cone tip at the same level as the bottom of the water outlet pipe 1, and the bottom fixedly connected with the intermediate rod 4 to facilitate elimination of an air column and allow the separated oil phase to gather to form a stable columnar oil core, and the oil core is enclosed by an annular water flow; the water outlet pipe 1 is frustum-shaped, with four strip outlet holes 9 evenly distributed around to discharge most of water in produced fluid; the drain cavity 2 is cylindrical and located outside the water outlet pipe 1, and encloses the water outlet pipe 1, with the lower edge of the drain cavity 2 connected with the drain pipe 10, and a water control valve 15 is connected to the drain pipe 10 to adjust flow at the water drain opening 11, thereby controlling the thickness of a low viscosity liquid ring at the flow outlet 7; after the drain cavity 2 collects and stabilizes liquid from the water outlet pipe 1, the collected water phase is discharged from the water drain opening 11 through the drain pipe 10 and reinjected into the formation; a water ring output by the water outlet pipe 1 encloses a central oil core to form a heavy oil-water flow for lubrication and drag reduction for transportation. The lubricating element is provided with a feed inlet 6, a water drain opening 11 and a heavy oil-water flow outlet 7 with water as an outer ring and heavy oil as a center.

The process of using the lubricating element to reduce drag in production and transportation of heavy oil includes the following basic steps:

1. Connecting the feed inlet 6 with the upstream production and transportation pipe, connecting the water drain opening 11 with a reinjection water pipe, and connecting the heavy oil-water flow outlet 7 with a downstream production and transportation pipe;

2. Opening the water control valve 15 and upstream and downstream production and transportation pipe valves to allow water-cut heavy oil to enter from the feed inlet 6;

3. After water-cut heavy oil enters stably through the flow stabilizing cone 14 and passes through the four chambers divided by the flow guide blades 13 for oil-water cyclone separation through the flow guide blades 13, and a heavy oil-water flow with water as an outer ring and heavy oil as a center is formed at the flow outlet 7 at the top of the lubricating element, adjusting the opening of the water control valve 15 to allow the thickness of a low viscosity liquid ring at the flow outlet 7 to be moderate, and to allow the separated water to enter the reinjection water pipe from the water drain opening 11 at the bottom of the drain cavity 2; and 4. If it is necessary to stop production and transportation of water-cut heavy oil, closing the upstream production and transportation pipe valve, and then closing the water control valve 15 and the downstream production and transportation pipe valve successively after a period of time.

What is claimed is:

1. A lubricating element for drag reduction in production and transportation of water-cut heavy oil in a wellbore, comprising:

a flow guide component composed of an intermediate rod, four flow guide blades, a center cone and a flow stabilizing cone, and a shell component composed of an inlet pipe, a cyclone pipe, a water outlet pipe, a drain cavity, a drain pipe and a ring formation pipe; wherein the inlet pipe is funnel-shaped, with a larger end connected with the cyclone pipe, and a smaller end connected with an upstream production and transportation pipe;

the flow stabilizing cone allows incoming liquid to uniformly and stably flow into four chambers divided by the four flow guide blades fixedly connected to sides of the intermediate rod, the four flow guide blades are distributed in a flow channel at an interval of 90° and integrated by using arc sections and straight sections, and the center cone is fixedly connected above the intermediate rod;

the water outlet pipe is frustum-shaped, with four strip outlet holes evenly distributed around;

the drain cavity is cylindrical and located outside the water outlet pipe, and encloses the water outlet pipe, with a lower edge of the drain cavity connected with the drain pipe, and a water control valve is connected to the drain pipe; whereby a water ring output by the water outlet pipe encloses a central oil core to form a heavy oil-water flow for lubrication and drag reduction for transportation;

an oil-water mixture flows into the lubricating element through a feed inlet; and finally water separated from the oil-water mixture is discharged through a water drain opening, and the heavy oil-water flow with water as an outer ring and heavy oil as a center flows out of a flow outlet.

2. The lubricating element for drag reduction in production and transportation of water-cut heavy oil in the wellbore according to claim 1, wherein a height ratio of the arc sections to the straight sections of the four flow guide blades is 4:1.

3. The lubricating element for drag reduction in production and transportation of water-cut heavy oil in the wellbore according to claim 1, wherein the feed inlet and the flow outlet have the same diameter.

4. The lubricating element for drag reduction in production and transportation of water-cut heavy oil in the wellbore according to claim 1, wherein a width of the four strip outlet holes is 2 mm-3 mm.

5. The lubricating element for drag reduction in production and transportation of water-cut heavy oil in the wellbore according to claim 1, wherein the center cone is located at a central axis of the cyclone pipe, with a top cone tip at the same level as a bottom of the water outlet pipe.

* * * * *